United States Patent [19]

Mino et al.

[11] Patent Number: 4,973,393

[45] Date of Patent: Nov. 27, 1990

[54] SURFACE-TREATED MAGNESIUM OR MAGNESIUM-ALLOY AND PROCESS FOR SURFACE TREATMENT OF MAGNESIUM OR MAGNESIUM ALLOY

[75] Inventors: Masato Mino, Tokorozawa; Goro Yamauchi, Higashimurayama; Kishio Arita, Kunitachi, all of Japan

[73] Assignee: Nippon Telegraph and Telephone Corp., Tokyo, Japan

[21] Appl. No.: 411,243

[22] Filed: Sep. 22, 1989

Related U.S. Application Data

[63] Continuation of Ser. No. 926,917, Nov. 3, 1986, abandoned.

[30] Foreign Application Priority Data

Nov. 5, 1985 [JP] Japan ..... 60-246211
Aug. 5, 1986 [JP] Japan ..... 61-182745

[51] Int. Cl.[5] ..... G23C 14/00
[52] U.S. Cl. ..... 204/192.31; 427/383.9
[58] Field of Search ..... 204/192.31; 428/649; 427/383.9

[56] References Cited

U.S. PATENT DOCUMENTS

| | | | |
|---|---|---|---|
| 2,651,835 | 9/1953 | Jackson | 428/649 |
| 2,881,514 | 4/1959 | Drummond | 428/649 |
| 3,012,904 | 12/1961 | Baer et al. . | |
| 3,148,952 | 9/1964 | Foerster et al. | 428/647 |
| 3,163,553 | 12/1964 | Commanday et al. | 427/383.9 |
| 3,631,835 | 1/1972 | Hamontre et al. | 428/649 |
| 4,125,646 | 11/1978 | Dean et al. | 427/383.9 |
| 4,141,760 | 2/1979 | Baldi | 148/31.5 |
| 4,150,178 | 4/1979 | Yagi et al. | 427/383.9 |
| 4,152,223 | 5/1979 | Wallace et al. | 427/383.9 |
| 4,157,923 | 6/1979 | Yen et al. | 427/383.9 |
| 4,309,315 | 1/1982 | Nakamura | 204/192.31 |
| 4,480,010 | 10/1984 | Sasanuna et al. | 204/192.31 |
| 4,520,268 | 5/1985 | Xu | 204/192.31 |
| 4,634,600 | 1/1987 | Shimizu et al. | 204/192.31 |
| 4,663,181 | 5/1987 | Murali | 204/192.31 |

FOREIGN PATENT DOCUMENTS

| | | |
|---|---|---|
| 730265 | 1/1943 | Fed. Rep. of Germany . |
| 730266 | 1/1943 | Fed. Rep. of Germany . |
| 2149634 | 4/1972 | Fed. Rep. of Germany . |
| 510404 | 8/1939 | United Kingdom . |
| 520592 | 4/1940 | United Kingdom . |
| 643877 | 9/1950 | United Kingdom . |
| 1583835 | 2/1981 | United Kingdom . |

OTHER PUBLICATIONS

Langdon et al., "Metal Finishing 55th Guidebook Directory 1987", Hackensack, NJ 1987, p. 457.
Chemical Abstracts, 77086u, vol. 101 (10) Sept. 1984.
L. F. Spencer, "Chemical Coatings for Magnesium Alloys", Metal Finishing, Sept. 1970, pp. 63–66.
L. F. Spencer, "Chemical Coatings for Magnesium Alloys", Metal Finishing, Oct. 1970, pp. 52–57.
Federal Rep. of Germany Apr. 10, 1987, Official Action in Application No. P 3637447.445.

*Primary Examiner*—John F. Niebling
*Assistant Examiner*—Steven P. Marquis
*Attorney, Agent, or Firm*—Kenyon & Kenyon

[57] ABSTRACT

An aluminum film is formed on the surface of a substrate magnesium or magnesium alloy, and the resulting product is heated in a non-oxidizing or reducing gas having a high hydrostatic pressure at a temperature ranging from the eutectic point of the magnesium or magnesium alloy and the different metal to a temperature at or below which neither of the magnesium or magnesium alloy and the different metal is molten. This treatment provides a boundary layer between the aluminum film and the magnesium or magnesium alloy. This boundary layer is free from pinholes running from the interface of the aluminum film and the boundary layer to the magnesium or magnesium alloy ground. This surface-treated magnesium or magnesium alloy has excellent corrosion resistance surface electric conductivity, thermal conductivity and heat shock resistance.

7 Claims, 10 Drawing Sheets

SEM

SEM

XMA(Aℓ)

XMA(Aℓ)

XMA(Mg)

XMA(Mg)

SURFACE-TREATED MAGNESIUM OR MAGNESIUM-ALLOY AND PROCESS FOR SURFACE TREATMENT OF MAGNESIUM OR MAGNESIUM ALLOY

This is a continuation of application Ser. No. 926,917, filed Nov. 3, 1986.

BACKGROUND OF THE INVENTION

FIELD OF THE INVENTION

The present invention relates to a surface-treated magnesium or magnesium alloy having not only improved corrosion resistance and surface electric conductivity but also excellent thermal conductivity and thermal shock resistance, which is suited for use in aerospace instruments, precision instruments, and automotive parts, and a process for a surface treatment of magnesium and a magnesium alloy.

DESCRIPTION OF THE PRIOR ART

Light alloys including aluminum (Al) alloys are widely used as metallic materials of aerospace instruments, precision instruments, and automotive parts with a view to decreasing the weights thereof, saving energy, and improving the performances thereof. A surface electric conductivity is required of a casing containing electric and electronic parts or circuits, such as a transponder casing for an artificial satellite, in order to secure a stable grounding and an electromagnetic interference resistance, which are important in obtaining good electric properties. In addition, a thermal conductivity is required of such a casing in order to efficiently conduct heat generated in packaged parts. In the case of Al alloys which have heretofore been used in such casings, there is no necessity for forming a thick rustproof film on the surface of an Al alloy because of excellent corrosion resistance of the alloy.

There has recently been a tendency to use, as materials of above-mentioned instruments, magnesium (Mg) alloys having a specific weight lighter by at least 30% than those of Al alloys instead of the latter. Since Mg is the most active metal among practical metals, however, a corrosion-proof surface treatment of Mg alloys is indispensable in practical use thereof. The surface treatment of Mg or Mg alloy is discussed in many reports including a report of Spencer, L. F., "Chemical Coatings for Magnesium Alloys" (Metal Finishing, Sept., 1970. pp. 63–66, and Oct., 1970, pp.52–57). However, the technique of preventing Mg or a Mg alloy from undergoing corrosion has not been established yet. Even when a rustproof film is formed on Mg or a Mg alloy by any ordinary chemical conversion treatment, anodizing treatment, wet plating, dry plating, or coating, micro pinholes are present in the rustproof film which cannot, therefore, prevent the diffusion of Mg into the surface film, to cause deterioration of the corrosion resistance. Further, when an electrically conductive film of gold, aluminum or the like is provided on the chemically treated or anodized film in order to provide a surface electric conductivity, a galvanic cell is formed between the Mg or Mg alloy and the electrically conductive film through the above-mentioned pinholes under wet circumstance, presenting a problem that corrosion of the Mg or Mg alloy notably proceeds.

Thus, no effective corrosion-preventing technique has been established for Mg or Mg alloy, let alone no Mg or Mg alloy having all of a corrosion resistance, a surface electric conductivity, and a thermal conductivity has been materialized, and no surface treatment process for preparing such Mg or Mg alloy has been developed.

SUMMARY OF THE INVENTION

Accordingly, an object of the present invention is to provide a surface-treated Mg or Mg alloy excellent in all of corrosion resistance, surface electric conductivity, and thermal conductivity.

Another object of the present invention is to provide a process for a surface treatment of Mg or Mg alloy for providing a surface-treated Mg or Mg alloy with excellent corrosion resistance, surface electric conductivity, and thermal conductivity.

In the first aspect of the present invention, a surface-treated magnesium or magnesium alloy comprises:

a substrate of magnesium or magnesium alloy;

a boundary layer on the substrate of magnesium or magnesium alloy; and a metal layer on the boundary layer, the metal being different from the magnesium or magnesium alloy;

the boundary layer being formed by mutual diffusion of magnesium and the different metal and having no pinholes running from an interface of the boundary layer and the different metal layer to the substrate.

Here, the different metal may be aluminum. A thin oxide film formed by a chromate treatment may be formed on the surface of the aluminum.

In the second aspect of the present invention, a process for a surface treatment of magnesium or magnesium alloy comprises:

a step of forming a film of a metal different from magnesium or a magnesium alloy on the surface of a substrate of magnesium or magnesium alloy; and a step of heating the substrate having thereon the film of different metal at a temperature ranging from the eutectic point of the magnesium or magnesium alloy and the different metal to a temperature at or below which neither of the magnesium or magnesium alloy and the different metal is molten.

Here, the different metal may be aluminum.

In the third aspect of the present invention, a process for a surface treatment of magnesium or magnesium alloy comprises:

a step of forming a film of a metal different from magnesium or magnesium alloy on the surface of a substrate of magnesium or magnesium alloy; and a step of heating the substrate having thereon the film of different metal in a pressurizing medium under a hydrostatic pressure, the heating being effected at a temperature ranging from the eutectic point of the magnesium or magnesium alloy and the different metal to a temperature at or below which neither of the magnesium or magnesium alloy and the different metal is molten.

Here, the different metal may be aluminum. The aluminum may be formed by ion plating.

A process for a surface treatment of magnesium or magnesium alloy may further comprise a step of subjecting the surface of the aluminum to a chromate treatment to form a thin oxide film thereon.

The pressure medium may be a non-oxidizing gas and/or a reducing gas.

The above and other objects, effects, features and advantages of the present invention will become more apparent from the following description of preferred embodiments thereof taken in conjunction with the accompanying drawings.

BRIEF DESCRIPTION OF THE DRAWINGS

FIG. 13A and FIG. 13B are X-ray microanalyzer photographs respectively showing the metallographic structures of the cross sections of comparative examples;

DETAILED DESCRIPTION OF PREFERRED EMBODIMENTS

Figure 1:
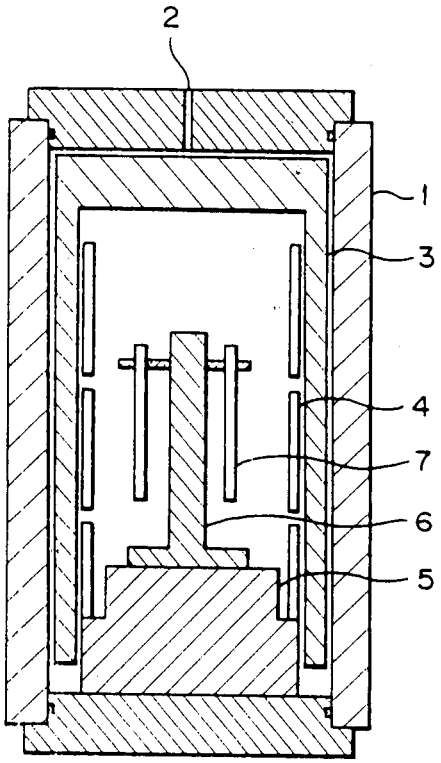
FIG. 1 is a cross sectional view of an apparatus for practicing the process of the present invention.

FIG. 1 shows the outline of an apparatus for practicing the process of the present invention. In the figure, the apparatus includes a pressure-resistant heating furnace 1, a gas inlet 2, a heat-insulating material 3, a heating element 4, a sample-supporting pedestal 5, a sample-supporting tool 6, and a sample 7.

Figure 2:
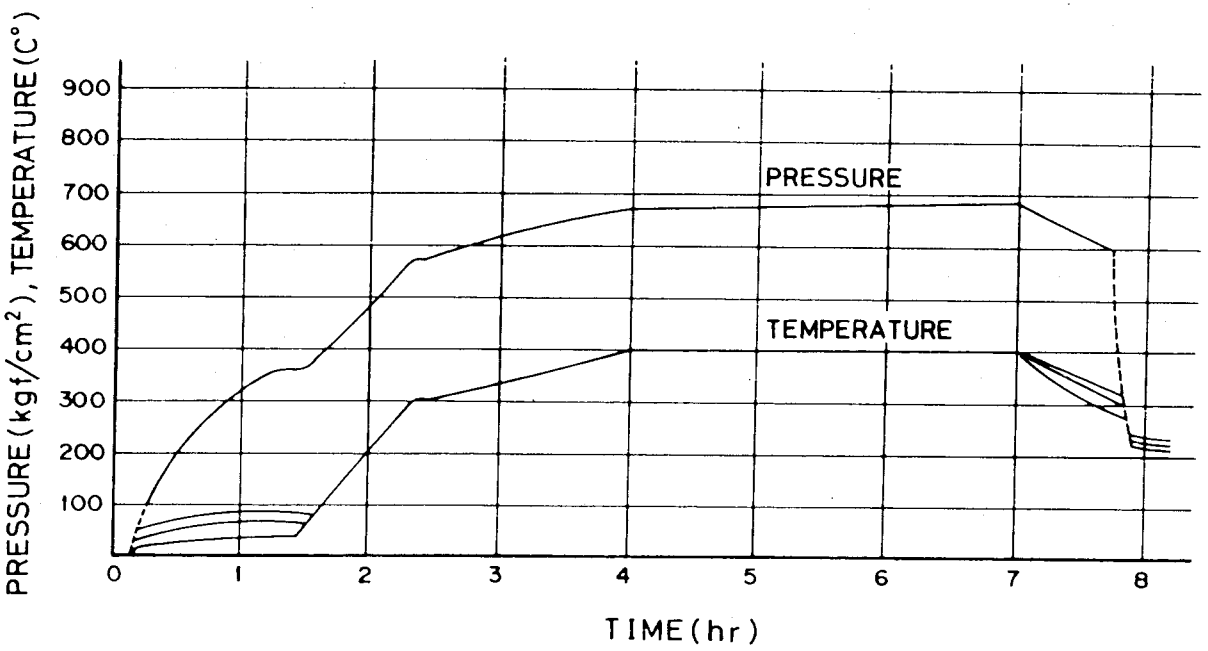
FIG. 2 is a time chart showing an example of method of pressurization and heating.

Mg alloy samples having an Al film formed thereon are placed in the pressure-resistant heating furnace 1. An inert or reducing gas is introduced into the furnace to raise the pressure in the furnace, and is heated. FIG. 2 is a time chart showing an instance of pressurization and heating in the furnace. After the pressure in the furnace is raised up to a given level (360 kgf/cm$^2$ in a case as shown in FIG. 2), the inside temperature of the furnace is elevated with the heating element 4. This increases the inside pressure of the furnace simultaneously with the rise in the inside temperature of the furnace. When the inside temperature of the furnace rises to 400° C., the inside pressure of the furnace reaches 680kgf/cm$^2$. In the case of FIG. 2, the maximum temperature and pressure is maintained for three hours, followed by decreasing the temperature and the pressure. The inside temperature and pressure of the furnace can be respectively, independently controlled. Three lines appearing on the low temperature side in the graph of temperature in FIG. 2 show respective temperature at three points of measurement inside the furnace.

Al films were formed on Mg alloy plates. The results of heating each Mg alloy plate having thereon the Al film in non-oxidative atmosphere, for example an inert atmosphere, under a high hydrostatic pressure were examined.

The Mg alloys used were an ASTM AZ31 alloy (3wt%Al-1wt%Zn-balance of Mg) and an ASTM ZK 60 alloy (5.5wt%Zn-0.5wt%Zr-balance of Mg). 4cm×5cm samples were cut from plates of 4mm in thickness respectively made of the above-mentioned alloys. An Al film having a thickness of 50μm was formed on the surface of each cut sample in an Ar atmosphere of $1\times10^4$ Torr by ion plating. Each resulting Mg alloy plate sample were placed in an apparatus as shown in FIG. 1, and heated under a high hydrostatic pressure of an argon gas. The pressure was 700kgf/cm$^2$. Four heating conditions, 460° C.×3 hours, 440° C.×3 hours, 410° C.×3 hours, and 200° C.×3 hours, were chosen, 3 hours are maintaining time at constant temperatures 460° C. and others. The bonding strength of an Al film in each sample was evaluated in accordance with the so-called peeling test comprising nicking the Al film in the longitudinal and lateral directions thereof with a cutter to form 100 blocks of 1 mm square, pressing a pressure-sensitive adhesive tape on the divided Al film, peeling the pressure-sensitive adhesive tape, and counting the number of blocks peeled from the Mg alloy substrate as they are adhering to the pressure-sensitive adhesive tape. The corrosion resistance was examined by a salt spray test using a 5% NaCl solution of 35° C. For the purpose of comparison, the same tests were carried out as regards samples obtained just after formation of an Al film and samples obtained by heating of an Al-film-formed Mg alloy plate sample in vacuum at 470° C. for three hours, at 430° C. for three hours, and at 400° C. for three hours, respectively. The results are summarized in Tables 1-1 and 1-2. The results of the peeling test and the salt spray test of each sample in Tables 1-1 and 1-2 are averages of values in four trials. In the column of the peeling test, a symbol "—" shows the the peeling test could not be made because of a partially molten Al film.

TABLE 1-1

| Sample No. | Alloy | Pressure | Temperature | Heating time | Appearance of Al film surface | Peeling test | Salt spray test |
|---|---|---|---|---|---|---|---|
| Example 1 | AZ31 | 700 kgf/cm$^2$ | 460°C. | 3 hours | Roughing of Surface (partially molten) | — | Corrosion occured in 4 hours spray |

TABLE 1-1-continued

| Sample No. | Alloy | Pressure | Temperature | Heating time | Appearance of Al film surface | Peeling test | Salt spray test |
|---|---|---|---|---|---|---|---|
| Example 2 | AZ31 | 700 kgf/cm$^2$ | 440°C. | 3 hours | Normal | 0/100 | Corrosion did not occur in 48 hours spray |
| Example 3 | AZ31 | 700 kgf/cm$^2$ | 410°C. | 3 hours | Normal | 0/100 | Corrosion did not occur in 48 hours spray |
| Example 4 | AZ31 | 700 kgf/cm$^2$ | 200°C. | 3 hours | Normal | 14/100 | Corrosion occured in 6 hours spray |
| Example 5 | ZK60 | 700 kgf/cm$^2$ | 460°C. | 3 hours | Roughing of Surface (partially molten) | — | Corrosion occured in 4 hours spray |
| Example 6 | ZK60 | 700 kgf/cm$^2$ | 440°C. | 3 hours | Roughing of Surface (partially molten) | — | Corrosion occured in 4 hours spray |
| Example 7 | ZK60 | 700 kgf/cm$^2$ | 410°C. | 3 hours | Normal | 0/100 | Corrosion did not occur in 48 hours spray |
| Example 8 | ZK60 | 700 kgf/cm$^2$ | 200°C. | 3 hours | Normal | 8/100 | Corrosion occured in 6 hours spray |

TABLE 1-2

| Sample No. | Alloy | Pressure | Temperature | Heating time | Appearance of Al film surface | Peeling test | Salt spray test |
|---|---|---|---|---|---|---|---|
| Comparative Example 9 | AZ31 | — | — | — | Normal | 48/100 | Corrosion occured in 2 hours spray |
| Comparative Example 10 | ZK60 | — | — | — | Normal | 48/100 | Corrosion occured in 2 hours spray |
| Comparative Example 11 | AZ31 | $1 \times 10^{-3}$-Torr | 470°C. | 3 hours | Partially molten | — | Corrosion occured in 4 hours spray |
| Comparative Example 12 | AZ31 | $1 \times 10^{-3}$-Torr | 430°C. | 3 hours | Normal | 10/100 | Corrosion occured in 8 hours spray |
| Comparative Example 13 | AZ31 | $1 \times 10^{-3}$-Torr | 400°C. | 3 hours | Normal | 18/100 | Corrosion occured in 8 hours spray |
| Comparative Example 14 | ZK60 | $1 \times 10^{-3}$-Torr | 470°C. | 3 hours | Partially molten | — | Corrosion occured in 4 hours spray |
| Comparative Example 15 | ZK60 | $1 \times 10^{-3}$-Torr | 430°C. | 3 hours | Normal | 10/100 | Corrosion occured in 8 hours spray |
| Comparative Example 16 | ZK60 | $1 \times 10^{-3}$-Torr | 400°C. | 3 hours | Normal | 16/100 | Corrosion occured in 8 hours spray |

Figure 3:
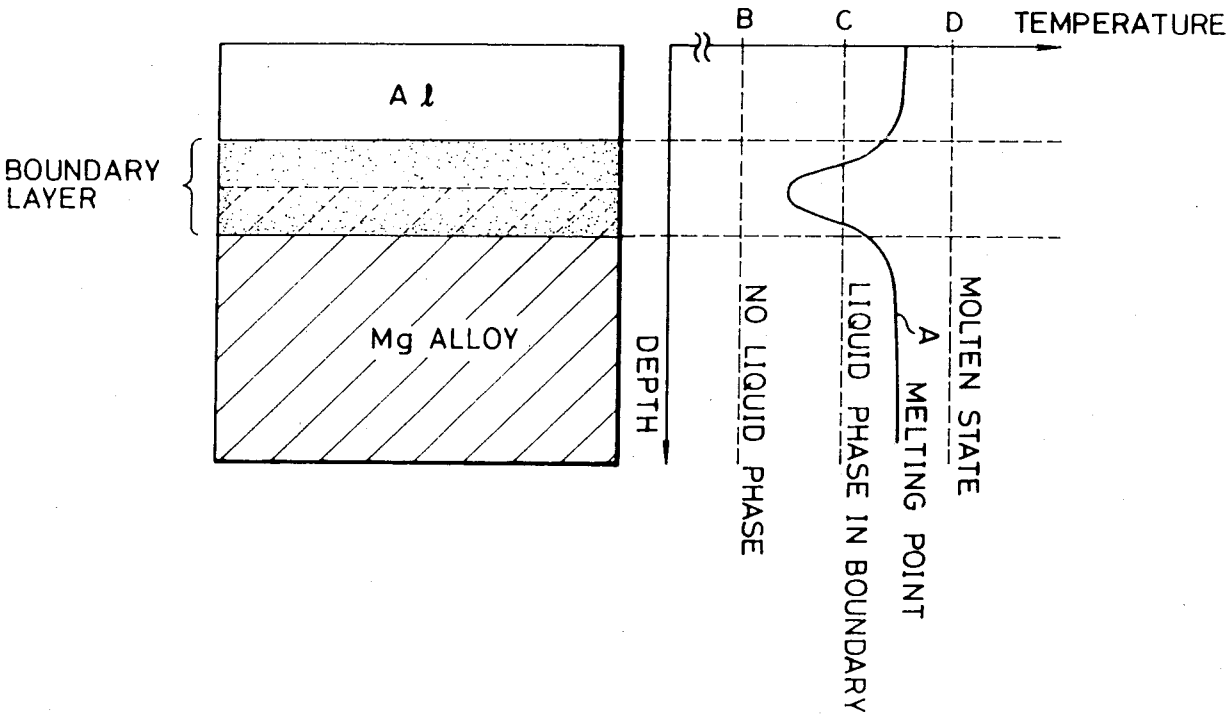
FIG. 3 is a schematic diagram showing a variation in melting point across the cross section of a surface-treated Mg alloy.

It will be understood from the results shown in Tables 1-1 and 1-2 that Samples Nos. 2 and 3 as examples according to the present invention, which were prepared from AZ31 under the conditions involving a hydrostatic pressure of 700kgf/cm$^2$ and heating conditions of 440° C.×3 hours and 410° C.×3 hours, respectively, as well as Sample No. 7 as an example according to the present invention, which was prepared from ZK60 under the conditions involving a hydrostatic pressure 700kgf/cm$^2$ and heating condition of 410° C.×3 hours, were largely improved in adhesion of an Al film to an Mg alloy substrate and corrosion resistance as compared with Samples Nos. 9 and 10 (comparative examples) obtained just after formation of an Al film. The reason for manifestation of such an effect will now be described with reference to schematic diagrams shown in FIGS. 3 and 4. FIG. 3 shows the cross section of Mg alloy having an Al film formed thereon and the melting points along the depth from the surface. The curve A shows a variation in the melting point where the boundary between Al and Mg is alloyed. Even if the Mg alloy covered by Al film is heated up to the temperature B, no liquid phase appears in the boundary. When the temperature is raised up to the point C, alloying of Al and Mg proceeds due to mutual diffusion thereof to form a liquid phase in the boundary therebetween. When the temperature was raised up to the point D, the whole is molten. Samples Nos. 2, 3, and 7 correspond to heating up to the point C in FIG. 3. It is believed that the adhesion of an Al film to a substrate alloy is increased due to pressurization of Al-film-formed Mg alloy heated above a temperature of 363° C. as the ternary eutectic point of ternary alloys of Al-Mg-Zn system in a state thereof wherein a liquid phase is partially formed in the boundary of the Mg alloy and the Al film, and that the density of the Al film is increased when pinholes are gotten rid of.

Figure 4:
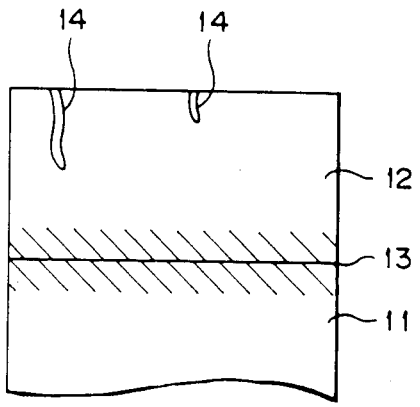
FIG. 4 is a schematic diagram of the cross section of a surface-treated Mg alloy as an example according to the present invention.

FIG. 4 schematically shows this state including a pinhole-free layer 13 having no pinholes formed between the Mg alloy substrate 11 and the Al film 12.

Pinholes 14 in the surface portion of the Al film 12 are markedly dwindled even if they cannot be completely gotten rid of.

The effect of heating at 200° C. for three hours, (Samples Nos. 4 and 8) was small because the temperature was too low. When heating was down at 460° C. for three hours, partial melting of the Al film occurred on the surfaces of the AZ31 alloy (Sample No. 1) and the ZK60 alloy (Sample No. 5). Although the melting point of Al is about 660° C., the formed Al film might have been alloyed with the Mg alloy and molten by heating at 460° C. since the formed Al film was as thin as 50μm. A difference in result of heating at 440° C. between alloys AZ31 and ZK60 is believed to have arisen because the latter's Zn content of 5.5% higher than that of the former lowered the liquidus temperature of Al-Mg-Zn alloys. Therefore, the effective heating temperature range under pressurization at a given hydrostatic pressure may range from the eutectic point of a substrate alloy (or metal) and a metal constituting a film to a temperature at or below which neither of them is molten. Among Samples Nos. 11 to 16 which were heated in vacuo without being pressurized at a hydrostatic pressure, Samples Nos. 11 and 14 underwent melting of the Al film because the temperature was too high. Samples Nos. 12, 13, 15 and 16 which were heated at 430° C. or 400° C. achieved some improvements but to a small extent as compared with Samples Nos. 9 and 10. Samples Nos. 2, 3, and 7 as examples according to the present invention showed excellent results in both of the peeling test and the salt spray test as compared with comparative examples wherein heating was done in vacuo.

Thermal conductivities of Examples Nos. 3 and 7 are measured. Disc-shape samples with diameter in 10 mm are cut off from plate after heat treating in high hydrostatic pressure, and thermal conductivities are measured along the direction of thickness. Resultant values and for comparison thermal conductivities of non-treated AZ31 alloy and ZK60 alloy are shown in Table 2, densities of samples are also shown in the same table. The thermal conductivities of Examples Nos. 3 and 7 are higher than those of non-treated Mg alloys.

Heat shock resistance of Example No. 7 was examined. This sample was subjected to a heat cycle of alternate repetition of keeping the same at −55° C. for 30 minutes and keeping the same at +85° C. for 30 minutes. Even after repeating 1,000 cycles microcracking and peeling of Al film did not generated.

TABLE 2

| | Thermal conductivity (W/mK) | Density (g/cm$^3$) |
|---|---|---|
| Example No. 3 | 106 | 1.78 |
| Example No. 7 | 137 | 1.84 |
| AZ31 Alloy | 96 | 1.77 |
| ZK60 Alloy | 121 | 1.83 |

Figure 5:
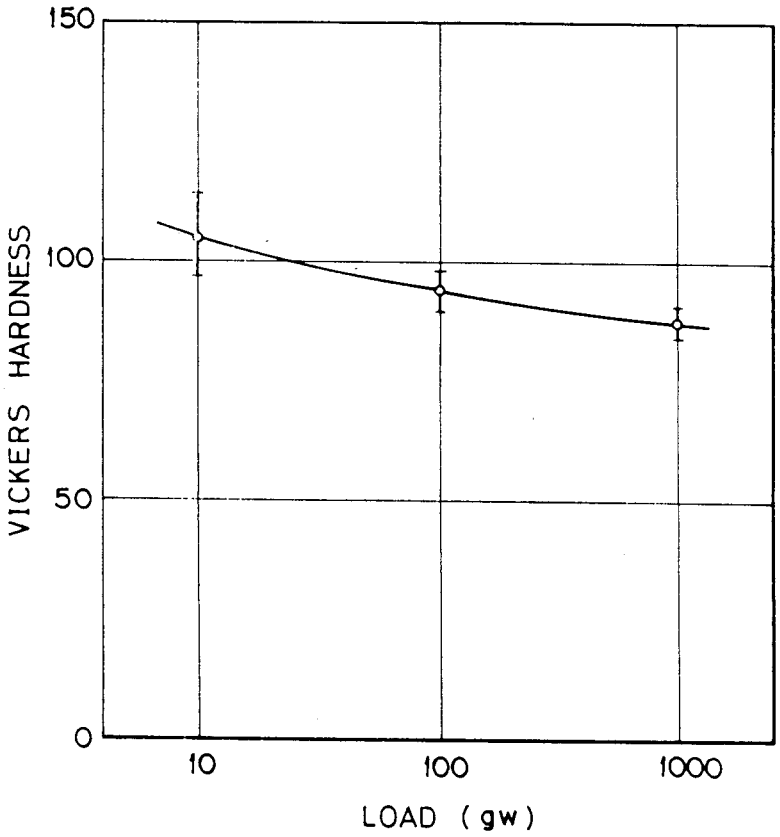
FIGS. 5 to 7 are diagrams showing relationships between the load and the Vickers hardness of a Mg alloy substrate, an Mg alloy in which Al film is formed, and a sample prepared by heat-treating an Al-film-formed Mg alloy under a high hydrostatic pressure, respectively.
Figure 6:
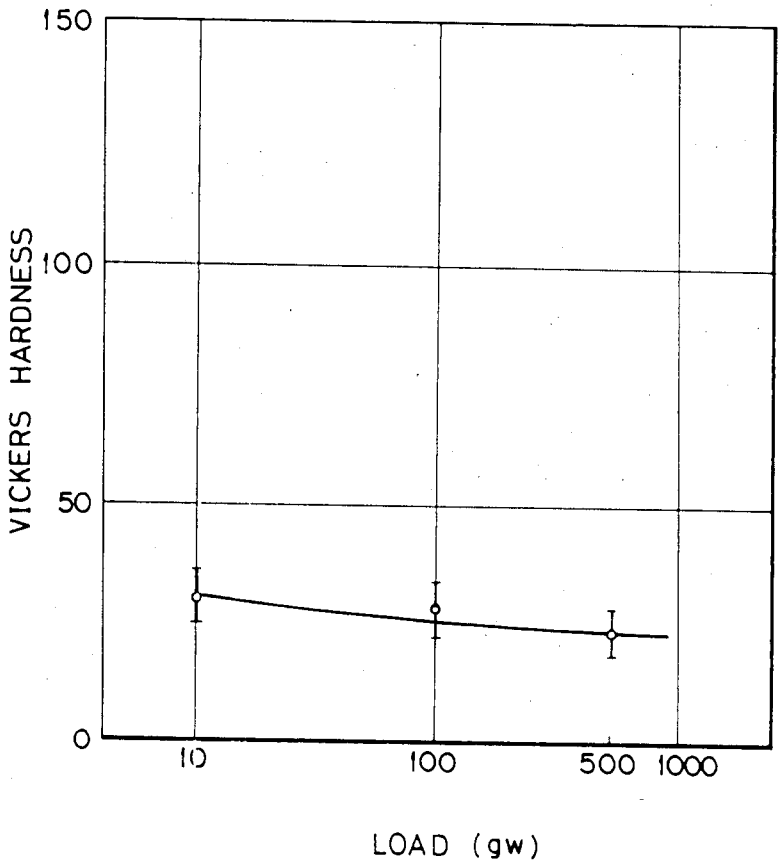
Figure 7:
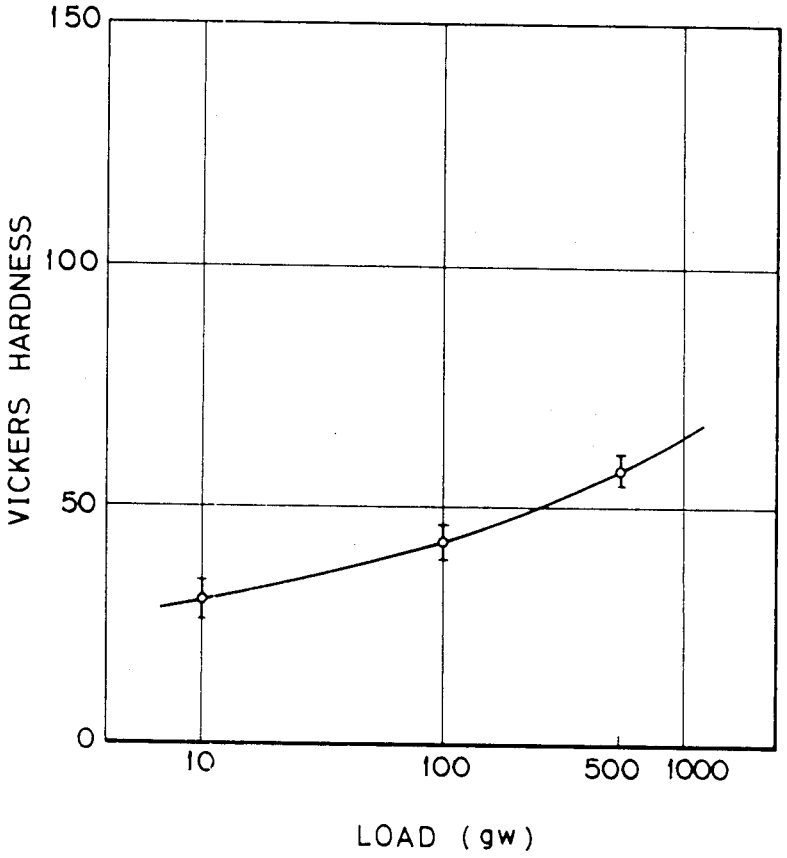

FIGS. 5 to 7 show Vickers hardnesses of the respective surfaces of a ZK60 Mg alloy substrate, an Mg alloy merely having an Al film formed thereon, and an Mg alloy having an Al film formed thereon and subjected to a high hydrostatic pressure and heating at 410° C. under 700kgf/cm$^2$. Each figure mentions an average value of hardness and dispersion of values. As is well known, the Vickers hardness of a soft metal varies in accordance with load, and generally decreases with an increasing load. The Vickers hardness of the Mg alloy substrate as shown in FIG. 5 complied with the above-mentioned general tendency. The Vickers hardness of the Al film as shown in FIG. 6, which did not provide correct values particularly on the light load side, showed a tendency to decrease with an increasing load. In contrast, the Vickers hardness of the Mg alloy having an Al film formed thereon and subjected to a heating treatment under a high hydrostatic pressure increased with an increasing load. This is so because the cone of a Vickers hardness tester might have reached a hard boundary layer formed between the Mg alloy substrate and the Al film by heating as schematically shown in FIG. 3 when the load became heavy. This boundary layer is a layer wherein Al and Mg diffused in each other as will be discussed in detail later. Additionally stated, surface buff polishing was done prior to the Vickers hardness measurement of the sample subjected to the high pressure heating treatment in order to obtain correct values.

Every one of Samples Nos. 1 to 16 treated under the conditions as listed in Tables 1-1 and 1-2 was subjected to a chromate treatment on the surface of the Al film, and then to the peeling test and the salt spray test. The chromate treatment was made by immersing the sample in Alodine 1200 manufactured by Nippon Paint Co., Ltd. for 10 seconds. The results of the peeling test and the salt spray test after the chromate treatment were substantially the same as those of samples not subjected to the chromate treatment except that the samples subjected to the chromate treatment showed a superior surface luster.

Figure 8:
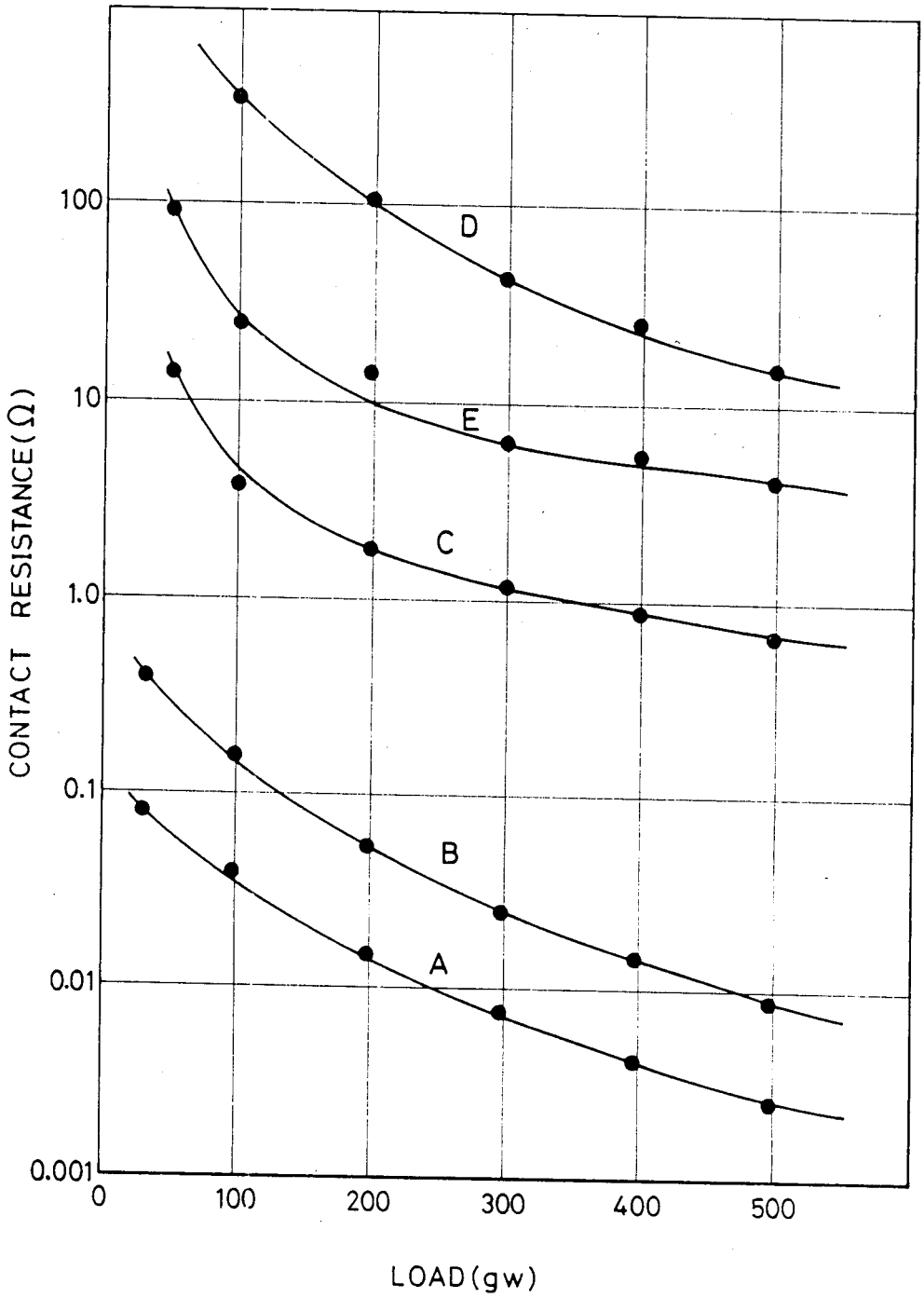
FIG. 8 is a diagram showing a comparison, in relationship between the contact resistance and the load, between an Al alloy and samples prepared by heat-treating an Al-film-formed Mg alloy under a high hydrostatic pressure.

A probe made of Au was pressed against every one of surface-treated Mg or Mg alloy samples to measure the electric resistance between the probe and the surface-treated Mg or Mg alloy sample with a milliohmmeter. In this way, the surface electric conductivity performance of the sample was evaluated. FIG. 8 shows variations in contact resistance with contact load as regards Sample No. 7 heated under a high hydrostatic pressure as it was and after it was subjected to the chromate treatment. In the figure, the curve A is concerned with the sample heated under a high hydrostatic pressure as it was, while the curves B and C are concerned with the sample after it was immersed in Alodine 1200 for three seconds and ten seconds, respectively, to effect the chromate treatment. The curve D which is concerned with ZK60 alloy and the curve E, which is concerned with a 5.2%Mg-0.1% Mn-0.1% Cr-Al alloy usually used in an instrument casing mounted on an artificial satellite, are shown for the purpose of comparison. As is shown in the figure, the surface-treated Mg alloy according to the present invention showed excellent surface electric conductivity due to the coverage of the surface thereof with the Al film. It was found that, when the Mg alloy having the Al film formed thereon and subjected to the heating treatment under a high hydrostatic pressure was subjected to the chromate treatment of the surface thereof, the contact resistance increased with an increasing immersion time, namely an increasing thickness of the resulting oxide film, but was still lower than a conventional Al alloy even after immersion for ten seconds.

The effect of heating in an atmosphere containing a reducing gas under a high hydrostatic pressure was examined.

The Mg alloys used were an ASTM AZ31 alloy and an ASTM ZK60 alloy. 4cmx5cm samples were cut from plates of 4 mm in thickness respectively made of the above-mentioned alloys in the same manner as described before. An Al film having a thickness of 50μm was formed on the surface of each cut sample in an Ar atmosphere of $1\times10^{-4}$ Torr by ion plating. Each resulting Mg alloy plate sample were placed in a pressure-resistant heating furnace 1, and was heated after the pressure of an argon gas containing 3% of CO was increased. The pressure was 700kgf/cm$^2$. 430° C.×3 hours, 400° C.×3 hours and 200° C.×3 hours, were chosen as heating conditions for the AZ31 alloy, while 400° C.×3 hours and 200° C.×3 hours were chosen as heating conditions for the ZK60 alloy. A temperature above a temperature of 363° C. as the eutectic point of a ternary Al-Mg-Zn system was chosen for every sample.

The same corrosion resistance test (salt spray test) and adhesion test (peeling test) as described before were carried out as regards every sample heat-treated under a hydrostatic pressure. The results are shown in Table 3.

TABLE 3

| Sample No. | Alloy | Pressure | Temperature | Heating time | Appearance of Al film surface | Peeling test | Salt spray test |
|---|---|---|---|---|---|---|---|
| Example 17 | AZ31 | 700 kgf/cm$^2$ | 430°C. | 3 hours | Normal | 0/100 | Corrosion did not occur in 48 hours spray |
| Example 18 | AZ31 | 700 kgf/cm$^2$ | 400°C. | 3 hours | Normal | 0/100 | Corrosion did not occur in 48 hours spray |
| Example 19 | AZ31 | 700 kgf/cm$^2$ | 200°C. | 3 hours | Normal | 8/100 | Corrosion occured in 6 hours spray |
| Example 20 | ZK60 | 700 kgf/cm$^2$ | 400°C. | 3 hours | Normal | 0/100 | Corrosion did not occur in 48 hours spray |
| Example 21 | ZK60 | 700 kgf/cm$^2$ | 200°C. | 3 hours | Normal | 8/100 | Corrosion occured in 6 hours spray |

AZ31 alloy samples (Samples Nos. 17 and 18) having an Al film formed thereon and heated under a high hydrostatic pressure of 700kfg/cm$^2$ and under heating conditions of 430° C.×3 hours and 400° C.×3 hours, respectively, showed good results like Sample Nos. 2 and 3 as examples according to the present invention as shown in Table 1-1, namely Al-film-formed AZ31 alloys heated under the same hydrostatic pressure and under heating conditions of 440° C.×3 hours and 410° C.×3 hours, respectively. A ZK60 alloy sample (Sample No. 20) having an Al film formed thereon and heated under heating conditions of 400° C.×3 hours showed good results like Sample No. 7 prepared from ZK60 alloy as shown in Table 1-1. According to this embodiment, the treatment in the reducing atmosphere improved the metallic luster of the surfaces of the samples as compared with that in the inert atmosphere. The effect of heating at 200° C. for three hours, (Samples Nos. 19 and 21) was small because the temperature was too low. A chromate treatment, which was carried out after the heating treatment under the high hydrostatic pressure, improved the surface luster like the heating treatment in the inart gas atmosphere.

The reason for the aforementioned large improvements in corrosion resistance and adhesion by the surface treatment according to the present invention has hereinbefore been described on the basis of the belief that the adhesion of an Al film to an Mg alloy substrate is increased as a result of pressurization of Mg alloy on which Al film is formed in a state wherein a liquid phase is partially formed in the boundary between the Al film and the Mg alloy as a result of heating at 400° C. or 440° C., which is above the eutectic point (363° C.) of a ternary Al-Mg-Zn system, to allow alloying of the Al film and the Mg alloy to proceed in the boundary between the Al film and the Mg alloy due to mutual diffusion thereof, while the density of the Al film is increased by getting rid of pinholes.

Figure 9:
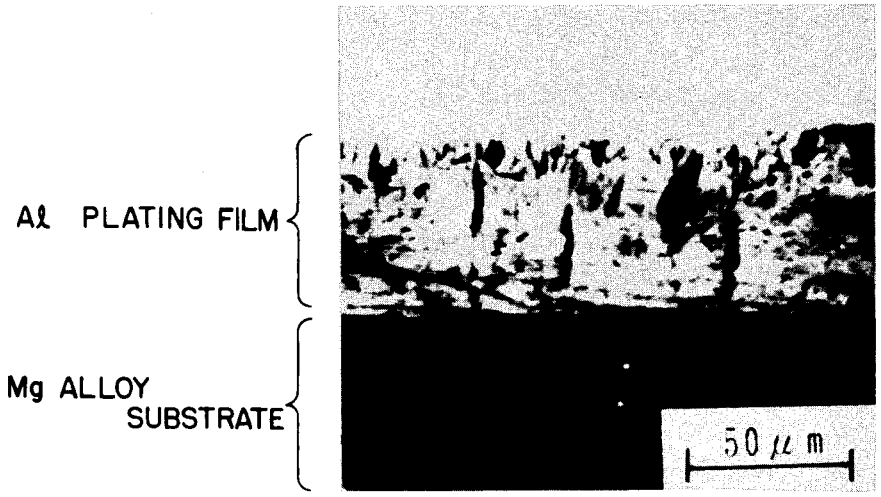
FIGS. 9 and 10 are scanning electron microscope photographs showing the crystalline structure of the cross section and the surface, respectively, of a comparative example.
Figure 10:
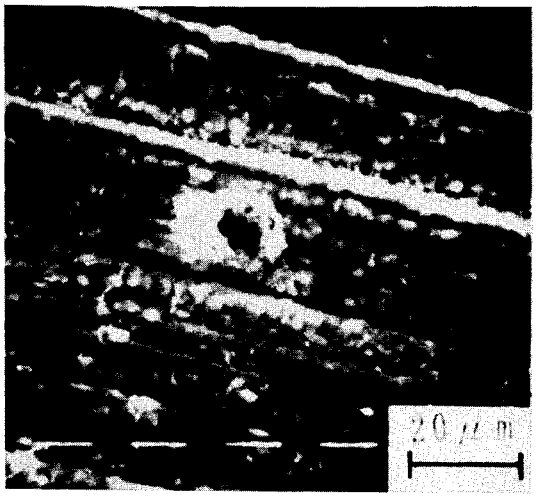
Figure 11:
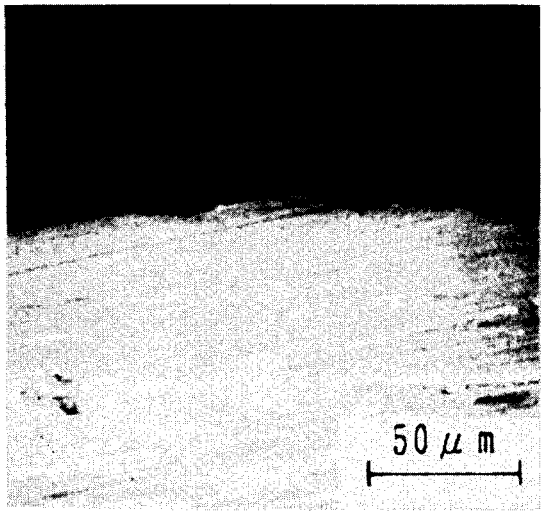
FIG. 11 is a scanning electron microscope photograph showing the crystalline structure of the cross section of an example according to the present invention.

For the purpose of substantiating this, structural observation was made with a scanning electron microscope (SEM) and an X-ray microanalyzer (XMA). FIGS. 9 and 10 are SEM photographs of the cross section and surface, respectively, of a sample having an Al film formed thereon but not subjected to any further treatment (comparative example, Sample No. 10). It could be confirmed from the SEM photographs that pinholes were present in the Al film. On the other hand, FIG. 11 is an SEM photograph of the cross section of a sample subjected to a surface treatment according to the present invention (Sample No. 20), in which photograph no pinholes running from the Al film layer to the Mg alloy substrate were observed.

Figure 12:
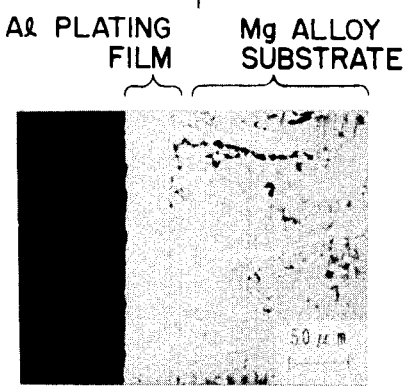
FIG. 12 is a scanning electron microscope photograph showing the metallographic structure of the cross section of a comparative example.
Figure 14:
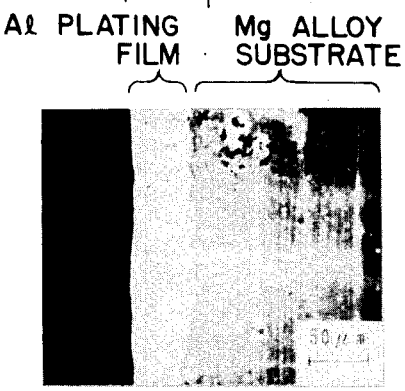
FIG. 14 is a scanning electron microscope photograph showing the metallographic structure of the cross section of an example according to the present invention.
Figure 18A:
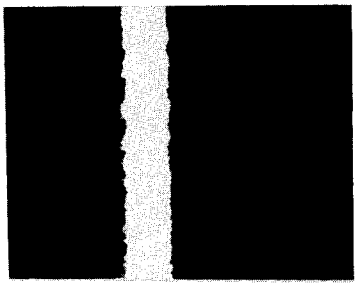
Figure 15A:
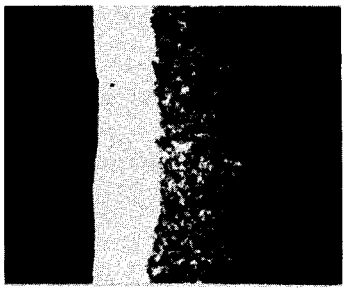
FIG. 15A and FIG. 15B are X-ray microanalyzer photographs respectively showing the metallographic structures of the cross sections of examples according to the present invention.
Figure 18B:
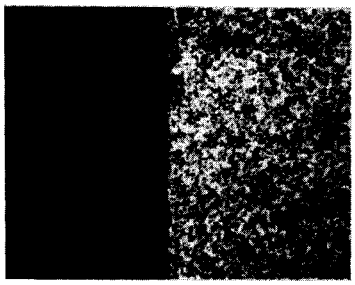
Figure 15B:
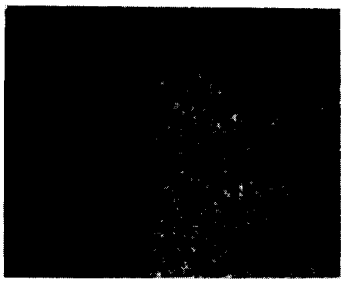

An SEM photograph of the cross section of a comparative example (Sample No. 10) is shown in FIG. 12, while XMA photographs of the cross sections of the Al film and Mg alloy of the same sample as mentioned just above are shown in FIGS. 13A and 13B, respectively. FIG. 14 is an SEM photograph of the cross section of the sample treated according to the present invention (Sample No. 20), while FIGS. 15A and 15B are XMA photographs of the cross sections of the Al film and Mg alloy, respectively, of the same sample as mentioned just above. In FIGS. 13A and 15A, the white portions were Al portions detected, while, in FIGS. 13B and 15B, the while portions were Mg portion detected. Occurrence of diffusion of the Al film and the Mg alloy into each other can be observed in the SEM photograph of FIG. 14. When FIGS. 13A and 15A are compared with FIGS. 13B and 15B, respectively, a difference in diffusion can be recognized very clearly. More specifically, in the comparative example, Al was detected only in the plating film without no trace of Al diffusion in the substrate, while Mg was detected only in the substrate without no trace of Mg diffusion in the plating film. In contrast, in the example, it was recognized that Al diffusion into the substrate and Mg diffusion into the plating film occurred. It can be confirmed from these photographs that mutual diffusion (Mg diffusion into the Al film and Al diffusion into the Mg alloy) briskly occurred by the surface treatment according to the present invention.

Although description has been made of instances wherein a gas was used as the pressurizing medium, a liquid can be used as the pressurizing medium in so far as a stable liquid state can be secured within the aforementioned effective temperature range. In the latter case, it may be desirable that Mg or Mg alloy having a film formed on the surface thereof be sealed with, for example, a polyimide resin sheet in the step of heating under a hydrostatic pressure like the rubber press process.

Although description has been made of instances wherein an alloys AZ31 or ZK60 was used as the substrate material, the process of the present invention can, needless to say, apply to other Mg alloys and pure Mg. Al film can be formed by thermal evaporating, sputtering, spray coating or cladding other than ion plating.

As described above, since Mg or Mg alloy having a film formed thereon is heated in pressurizing medium under a hydrostatic pressure, the adhesion between the Mg or Mg alloy and the film on the surface thereof can be increased, while at the same time the density of the film can be increased. This can lead to marked improvements in rustproof, abrasion resistance, and thermal shock resistance. When a reducing medium is used as the pressurizing medium, the metallic luster of a surface film can be increased, leading to improvements in decoration and surface electric conductivity. Further, since the process for a surface treatment according to the present invention is concerned with only metallic materials unlike conventional surface treatment process involving an anodizing treatment or a plastic coating treatment for improving the corrosion resistance of an object to be treated, the thermal conductivity of a treated object is remarkably improved. This enables Mg or Mg alloy to be used in thermally severe environments where it could not have been used.

What is claimed is:

1. A process for a surface treatment of magnesium or magnesium alloy comprising the steps of:

forming a film of aluminum on a surface of a substrate of magnesium or magnesium alloy; and subsequently heating said substrate, having thereon said film of aluminum, in a pressurizing medium under a hydrostatic positive pressure greater than one atmosphere, said heating being effected at a temperature ranging from the eutectic point of said magnesium or said magnesium alloy and aluminum to a temperature at or below which neither said magnesium or said magnesium alloy nor said aluminum is molten.

2. A process for a surface treatment of magnesium or magnesium alloy as claimed in claim 1, further comprising the step of subjecting the exposed surface of said film to a chromate treatment to form a thin oxide film thereon.

3. A process for a surface treatment of magnesium or magnesium alloy as claimed in claim 1, wherein said pressure medium is a non-oxidizing gas.

4. A process for a surface treatment of magnesium or magnesium alloy as claimed in claim 1, wherein said pressure medium is a reducing gas.

5. A process for surface treatment of magnesium or magnesium alloy according to claim 1, wherein said aluminum film is formed by ion plating.

6. A process for a surface treatment of magnesium or magnesium alloy according to claim 1, wherein said magnesium alloy is an Mg-Al-Zn alloy and said heating is effected at a temperature ranging from 363° C. to 440° C.

7. A process for a surface treatment of magnesium or magnesium alloy according to claim 1, wherein said magnesium alloy is an Mg-Zn-Zr alloy and said heating is effected at a temperature ranging from 363° C. to 410° C.

* * * * *